United States Patent [19]

Judd et al.

[11] Patent Number: 4,549,933

[45] Date of Patent: Oct. 29, 1985

[54] DOCTOR BLADE WITH NON-HOMOGENEOUS STIFFNESS PROPERTIES

[75] Inventors: Michael Judd, Paxton; Joseph S. Cooper, Worcester, both of Mass.

[73] Assignee: Thermo Electron Corporation, Waltham, Mass.

[21] Appl. No.: 510,883

[22] Filed: Jul. 5, 1983

[51] Int. Cl.[4] ..... D21G 3/00; D21G 3/02; D21G 3/04

[52] U.S. Cl. ..... 162/281; 15/256.51; 428/113

[58] Field of Search ..... 15/256.51; 162/281, 162/280; 428/36, 105, 113, 902, 114; 100/174; 101/169

[56] References Cited

U.S. PATENT DOCUMENTS 2,767,529 10/1956 Scott ..... 15/256.51
3,768,760 10/1973 Jensen ..... 428/105 X
4,173,670 11/1979 Van Auken ..... 428/36

*Primary Examiner*—Steve Alvo
*Attorney, Agent, or Firm*—Maurice E. Gauthier

[57] ABSTRACT

A composite doctor blade with non-homogeneous stiffness properties and having a plurality of juxtaposed fibrous layers which are encapsulated in an epoxy resin. The composite blade has a fibrous core, intermediate uni-directional graphite fiber layers and outer fibrous layers. The uni-directional graphite fibers in the intermediate layers are oriented in the machine direction.

9 Claims, 7 Drawing Figures

DOCTOR BLADE WITH NON-HOMOGENEOUS STIFFNESS PROPERTIES

BACKGROUND OF THE INVENTION

1. Field of the Invention

The present invention relates to doctor blades and, more particularly, is directed towards doctor blades for papermaking machines.

2. Description of the Prior Art

Doctor blades contact the surface of rotating rolls of papermaking machines for various purposes, such as roll cleaning and sheet shedding. Conventional doctor blades have been constructed either of a hard material, such as metal, or a soft material, such as plastic. Hard doctor blades do not conform readily to the contour of the moving surface of the roll against which they are pressed. On the other hand, soft doctor blades wear out too quickly with the result that they have to be reground and replaced frequently.

Generally, metal blades are made of steel, stainless steel, nickle, bronze, etc. Steel is preferred because it is inexpensive and it has high stiffness and good wear characteristics. The drawback with steel blades is that they are susceptible to corrosion in wet environments. In addition, steel blades cause the rolls to wear prematurely.

Plastic doctor blades are employed in places where steel blades can not be used. Plastic blades having the same thickness as comparable steel blades do not have sufficient stiffness in the machine direction. In order to compensate for this deficiency, plastic blades are made relatively thick, for example 1/16" to ¼". Thick blades suffer from the disadvantage that additional power is required to drive the roll against which the blade is pressed, the power required being proportional to blade thickness. More particularly, since the surface area of thick blades is greater than that of thin blades, more force is required to press the thick plastic blade against the roll in order to achieve the desired loading pressure. This in turn results in higher torques and greater power losses. Also, the doctoring edge of the thick plastic blade tends to deflect outwardly with the results that the material being doctored starts to work its way between the blade and the surface being doctored. Furthermore, plastic doctor blades normally begin to degrade, that is, lose stiffness or develop blisters when operating at temperatures in the range of 200° F.–300° F.

U.S. Pat. No. 2,767,529 shows a doctor blade composed of alternate frangible and wear resisting laminations of mildly abrasive and non-abrasive materials, respectively. U.S. Pat. Nos. 3,768,760 and 4,173,670 respectively show an airfoil with graphite fibers and a tubular element with graphite fibers.

SUMMARY OF THE INVENTION

It is an object of the present invention to provide an improved doctor blade which does not suffer from the disadvantages and limitations heretofore mentioned.

It is another object of the present invention to provide a composite, thin doctor blade composed of a synthetic material that is sufficiently stiff in the machine direction to provide satisfactory doctoring and sufficiently flexible in the cross machine direction to readily conform to surface irregularities. The blade has a plurality of fibrous layers in an epoxy resin. A fibrous core layer, which is centered at the neutral axis of the blade, is sandwiched between two intermediate layers having regions of uni-directional graphite fibers arranged in the machine direction. The intermediate layers are bounded by fibrous outer layers. The machine direction orientation of uni-directional graphite fibers in a multi-layered fibrous doctor blade results in a blade having non-homogeneous stiffness properties and which is capable of operating satisfactorily at temperatures up to 350° F. In addition, graphite has a lower coefficient of friction than metal which results in a doctor blade having lower power consumption.

The invention accordingly comprises the apparatuses, together with their parts, elements and interrelationships, that are exemplified in the following disclosure, the scope of which will be indicated in the appended claims.

BRIEF DESCRIPTION OF THE DRAWINGS

A fuller understanding of the nature and objects of the present invention will become apparent upon consideration of the following detailed description taken in connection with the accompanying drawings, wherein.

DETAILED DESCRIPTION OF THE PREFERRED EMBODIMENTS

Figure 2:
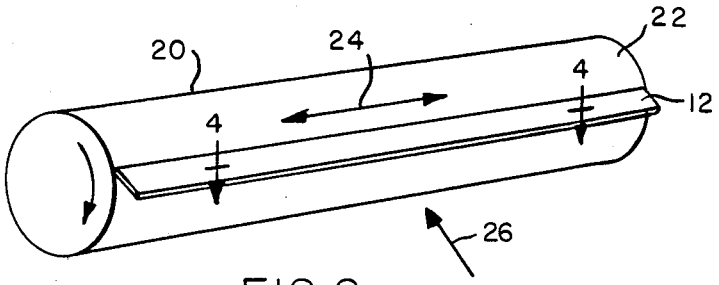
FIG. 2 is a schematic diagram of the doctor blade pressed against the roll.
Figure 1:
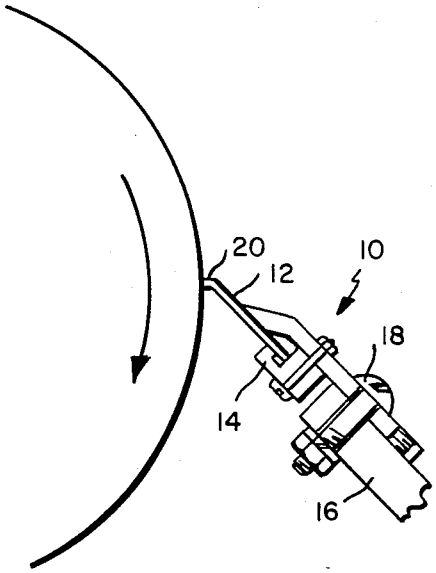
FIG. 1 is a side view of a doctor blade assembly embodying the invention pressed against a roll.
Figure 3:
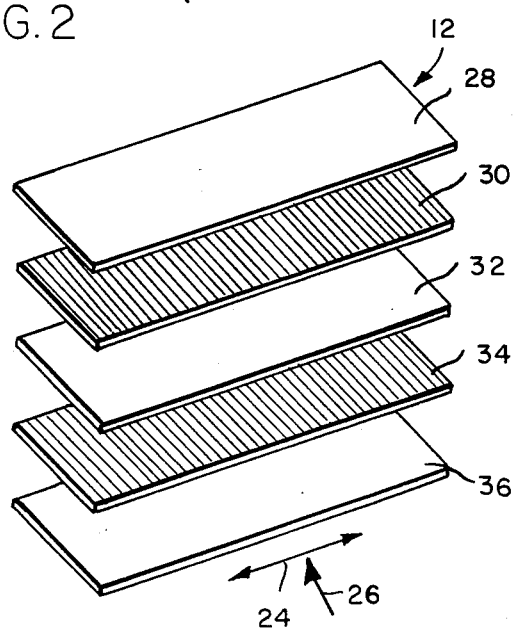
FIG. 3 is an exploded perspective view of a preferred embodiment of a doctor blade in accordance with the present invention.
Figure 4:
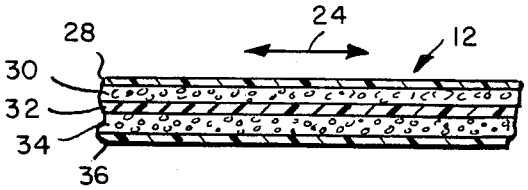
FIG. 4 is a cross-sectional view taken along the line 4—4 in FIG. 2.

Referring now to the drawings, particularly FIGS. 1 and 2, there is shown a doctor assembly 10 which is employed in papermaking machines for cleaning, sheet-shedding and other like operations. Doctor assembly 10 includes an elongated doctor blade 12 which is held in a holder 14 that is clamped firmly to a rigid back 16 by bolts 18. A leading bevelled edge 20 of doctor blade 12 bears against a roll 22. In the following description, the "cross machine direction", which is denoted by arrow 24 in FIG. 2, is the direction that is parallel to the axis about which roll 22 rotates. The "machine direction", which is denoted by arrow 26, is the diection that is transverse to the rotational axis of the roll 22. As hereinafter described, doctor blade 12 is a composite structure having a plurality of layers 28, 30, 32, 34 and 36 which are bound together by an epoxy resin, plastic or the like to form a single sheet. As shown in FIGS. 3 and 4, layers 28, 30, 32, 34 and 36 are coextensive and superposed one on the other to form a sandwich structure which constitutes doctor blade 12.

Layer 32 is a central core about which layers 28, 30, 34 and 36 are disposed. The thickness of core 32 is in the range of 0.005 to 0.025 inch. Core 32 is centered on the neutral axis of blade 12 and is comprised of a natural or synthetic fibrous material such as cotton, paper, fiberglass and the like. Intermediate layers 30 and 34 are comprised of uni-directional graphite fibers arranged in the machine direction. The thick layers 30 and 34 is in the range of 0.005 to 0.025 inch, the layers being spaced from the neutral axis by core 32. Layers 30 and 34 are sandwiched between outer layers 28, 36 and core 32. Outer layers 28 and 36 contain multi-directional fibers and may be comprised of natural materials such as cotton, paper or the like, or synthetic materials such as fiberglass. Preferably, the outer layers 28 and 36 are selected of materials having the capability to withstand splintering during cutting and grinding of blade 12. Outer layers 28 and 36 are relatively thin compared to layers 30 and 34 and have a thickness in the range of 0.002 to 0.008 inch. In the preferred embodiment, outer layers 28, 36 and core 32 are comprised of the same material.

As a result of the machine direction orientation of the uni-directional graphite fibers in intermediate layers 30 and 34, the layers being spaced from the neutral axis by core 32, and outer layers 28 and 36, doctor blade 12 is characterized by non-homegeneous stiffness properties. This orientation of uni-directional graphite fibers provides adequate stiffness in the machine direction for good doctoring action and sufficient flexibility in the cross machine direction to allow the blade to conform readily to roll 22 surface irregularities. High stiffness and strength in the machine direction permits required blade loading with low deflection and without unacceptable increases in blade thickness which translate into power losses. Lower stiffness in the cross machine direction allows the blade to conform to roll surface irregularities without large changes in the required blade loading. The result is a doctor blade which has a thickness typically in the range of 0.025" to 0.070" and provides better doctoring action with a more uniform force (p.s.i.) across the roll surface and with less severe and more uniform wear of both the blade edge and the roll surface.

Figure 5:
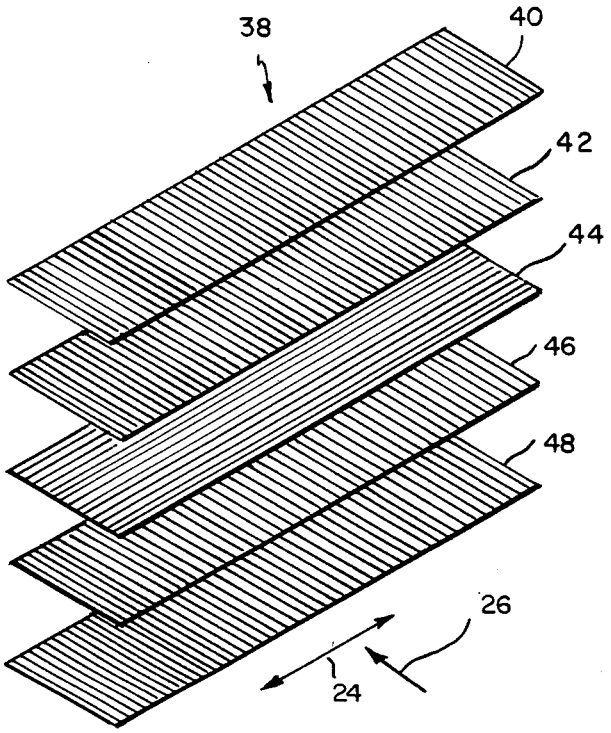
FIG. 5 is an exploded view of an alternate embodiment of the doctor blade of FIG. 1.

Referring now to FIG. 5, there is shown a doctor blade 38 which is an alternate embodiment of blade 12. Doctor blade 38 is a composite structure having a plurality of layers 40, 42, 44, 46 and 48 which are pressed together to form a single sheet. In this embodiment, each layer of blade 38 is comprised of uni-directional graphite fibers in an epoxy resin matrix. The layers are coextensive and superposed in contact with one another to form a sandwich structure. The orientation or the direction of the uni-directional graphite fibers in at least some of the layers are non-parallel with respect to the orientation or direction of the uni-directional graphite fibers in at least one other layer. In the embodiment of FIG. 5, the uni-directional graphite fibers of outermost layers 40, 42, 46 and 48 are oriented in the machine direction and the uni-directional graphite fibers of intermediate layer 44 are oriented in the cross machine direction. The number of layers and their arrangement of uni-directional graphite fibers can of course be changed to suit a wide variety of operational requirements.

The non-parallel orientation of the uni-directional graphite fibers is such that doctor blade 38 is characterized by non-homogeneous stiffness properties. This orientation of uni-directional graphite fibers again provides adequate stiffness in the machine direction for good doctoring action and sufficient flexibility in the cross machine direction to allow the blade to conform to roll surface irregularities.

Figure 6:
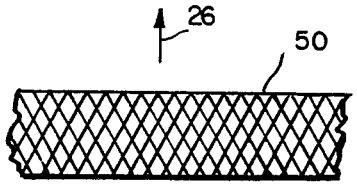
FIG. 6 is a plan view of another embodiment of the invention.
Figure 7:
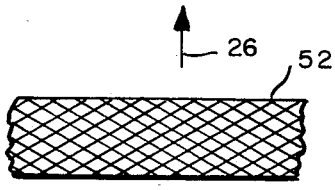
FIG. 7 is a plan view of still another embodiment of the invention.

In other alternate embodiments of the invention, the uni-directional graphite fibers are in directions which are other than in alignment with either the machine or cross machine directions. For example, in the embodiment shown in FIG. 6, a composite doctor blade 50 has uni-directional graphite fibers in an epoxy resin matrix in which the orientation of the fibers in at least one layer is in a direction which is at an angle somewhat less than or equal to 45° measured clockwise from the machine direction and the orientation of the uni-directional graphite fibers of at least one other layer is at an angle somewhat less than or equal to 45° measured counter-clockwise from the machine direction. In the embodiment of FIG. 7, there is shown a multiple layered composite doctor blade 52 in which the orientation of the uni-directional graphite fibers in at least one layer is in a direction which is an angle somewhat equal to or greater than 45° measured clockwise from the cross machine direction and the orientation of the uni-directional graphite fibers of at least one other layer is at an angle somewhat equal to or greater than 45° measured counter clockwise from the cross machine direction. The embodiments of FIGS. 6 and 7 resist any tendency that cross machine fibers might have to separate bodily from the bevelled working edge of the doctor blade.

In each embodiment, the doctor blade has regions of uni-directional graphite fibers arranged in the machine direction and spaced from the neutral axis to form a doctor blade with non-homogeneous stiffness properties, the stiffness in the machine direction being greater than the stiffness in the cross machine direction.

Since certain changes may be made in the foregoing disclosure without departing from the scope of the invention herein involved, it is intended that all matter contained in the above description and depicted in the accompanying drawings be construed in an illustrative and not in a limiting sense.

What is claimed is:

1. An elongated doctor blade having a side edge structured for application to a roll surface in a paper making machine, said blade comprising: an inner first layer of fibrous material lying on a neutral axis of said blade, and a plurality of second layers juxtaposed on opposite sides of said inner first layer, said second layers having uni-directional graphite fibers oriented so as to provide said blade with a stiffness in the direction perpendicular to said edge which is greater than the stiffness of said blade in the direction parallel to said edge.

2. The doctor blade of claim 1 wherein said uni-directional fibers are perpendicular to said edge.

3. The doctor blade of claim 1 further comprising third layers overlying said second layers.

4. The doctor blade of claim 3 wherein said first and third layers include multi-directional fibers, at least some of which are not perpendicular to said edge.

5. The doctor blade of claim 3 wherein said third layers have a thickness of about 0.005".

6. The doctor blade of claim 1 wherein said second layers each have a thickness in the range of 0.005" to 0.025".

7. The doctor blade of either claims 1 or 6 wherein the thickness of said first layer is in the range of 0.005" to 0.025".

8. The doctor blade of claim 1 wherein said second layers are encapsulated in an epoxy resin.

9. The doctor blade of claim 1 wherein the combined thickness of said first and second layers in the range of 0.025" to 0.070".

* * * * *